US007876192B2

(12) United States Patent
Bausch et al.

(10) Patent No.: US 7,876,192 B2
(45) Date of Patent: Jan. 25, 2011

(54) THERMAL AND/OR MAGNETIC OVERLOAD TRIP

(75) Inventors: Christoph Bausch, Bonn (DE); Rainer Schmidt, St. Augustin (DE)

(73) Assignee: Eaton Industries GmbH, Bonn (DE)

( * ) Notice: Subject to any disclaimer, the term of this patent is extended or adjusted under 35 U.S.C. 154(b) by 88 days.

(21) Appl. No.: 12/304,703

(22) PCT Filed: May 11, 2007

(86) PCT No.: PCT/EP2007/004198

§ 371 (c)(1),
(2), (4) Date: Dec. 12, 2008

(87) PCT Pub. No.: WO2007/144050

PCT Pub. Date: Dec. 21, 2007

(65) Prior Publication Data

US 2009/0195346 A1 Aug. 6, 2009

(30) Foreign Application Priority Data

Jun. 14, 2006 (DE) ..... 10 2006 027 544
Mar. 7, 2007 (DE) ..... 10 2007 010 944

(51) Int. Cl.
*H01H 71/40* (2006.01)
*H01H 75/00* (2006.01)
*H01H 71/14* (2006.01)
*H01H 71/16* (2006.01)

(52) U.S. Cl. ..... 337/13; 337/12; 337/14; 337/15; 337/35; 337/36; 337/37; 337/38; 337/39; 337/40; 337/85

(58) Field of Classification Search ..... 337/12–15, 337/35–40, 85
See application file for complete search history.

(56) References Cited

U.S. PATENT DOCUMENTS 2,922,007 A * 1/1960 Edmunds ..... 337/7

(Continued)

FOREIGN PATENT DOCUMENTS

DE 1982490 4/1968

(Continued)

OTHER PUBLICATIONS

International Search Report for International No. PCT/EP2007/004198 mailed on Aug. 3, 2007.

*Primary Examiner*—Anatoly Vortman
(74) *Attorney, Agent, or Firm*—Leydig, Voit & Mayer, Ltd.

(57) ABSTRACT

A thermal and/or magnetic overload trip device for an electrical switching device having multiple poles includes a housing having a housing member configured to receive a plurality of functional elements and being at least partially closable. The overload trip device further including a conductor strap associated with each of the multiple poles, each conductor strap having an associated housing portion, and a rotatable trip shaft configured to rotate between a rest position and an actuating position so as to trip an associated switching mechanism. The overload trip device further including at least one rotatable adjusting element configured to set the at least one of the presettable thermal threshold and the presettable magnetic threshold. Further, the housing member is configured so that the functional elements is insertable therein and is couplable to the housing member.

22 Claims, 3 Drawing Sheets

U.S. PATENT DOCUMENTS

| | | | | | |
|---|---|---|---|---|---|
| 2,981,811 | A * | 4/1961 | Steven et al. | 335/21 |
| 3,162,739 | A * | 12/1964 | Klein et al. | 335/9 |
| 3,421,123 | A * | 1/1969 | Laubenheimer et al. | 335/35 |
| 4,281,359 | A * | 7/1981 | Bayer et al. | 361/115 |
| 4,300,110 | A * | 11/1981 | Bayer et al. | 335/6 |
| 4,922,220 | A * | 5/1990 | Livesey et al. | 337/82 |
| 5,831,499 | A * | 11/1998 | Batteux et al. | 335/9 |
| 5,872,495 | A * | 2/1999 | DiMarco et al. | 335/35 |
| 5,894,259 | A * | 4/1999 | Kolberg et al. | 337/333 |
| 6,100,777 | A * | 8/2000 | Mueller et al. | 335/35 |
| 6,144,271 | A * | 11/2000 | Mueller et al. | 335/202 |
| 6,229,418 | B1 * | 5/2001 | Mueller et al. | 335/202 |
| 6,545,584 | B2 * | 4/2003 | Turner | 337/38 |
| 6,621,403 | B2 * | 9/2003 | Nagahiro et al. | 337/75 |
| 6,661,329 | B1 * | 12/2003 | Gibson | 337/84 |
| 7,323,956 | B1 * | 1/2008 | Puskar et al. | 335/6 |
| 2004/0066260 | A1 * | 4/2004 | Rodriguez et al. | 335/172 |
| 2005/0024172 | A1 * | 2/2005 | Puskar et al. | 335/172 |
| 2009/0295516 | A1 * | 12/2009 | Puhalla et al. | 335/35 |

FOREIGN PATENT DOCUMENTS

| | | |
|---|---|---|
| DE | 10036350 | 2/2002 |
| DE | 10113040 | 9/2002 |
| EP | 0848404 | 6/1998 |

* cited by examiner

Fig.3
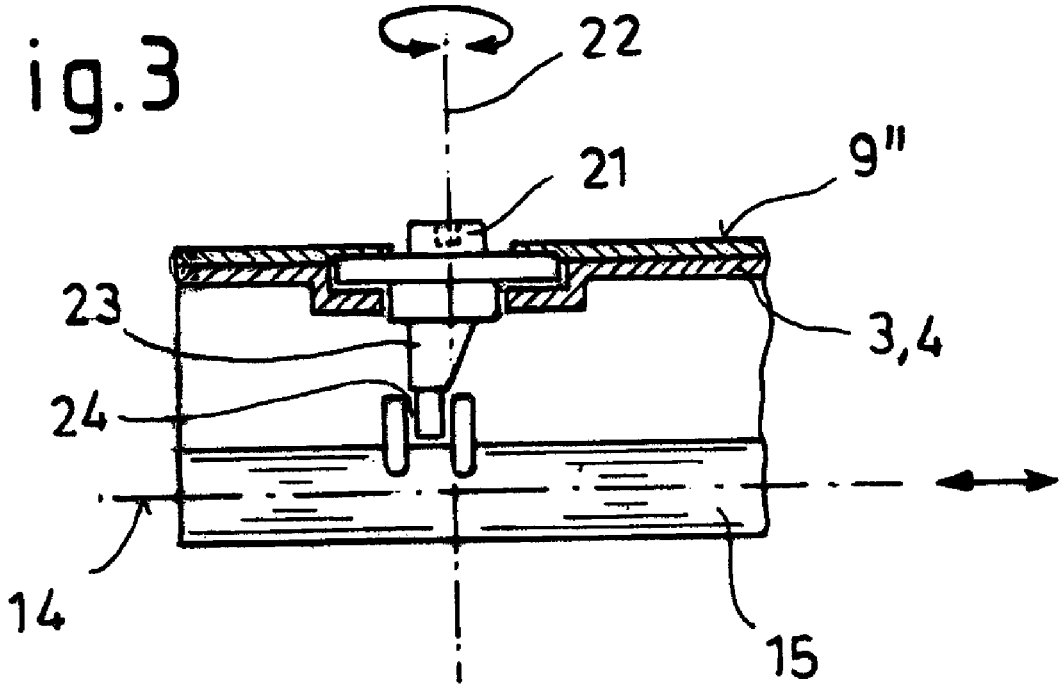
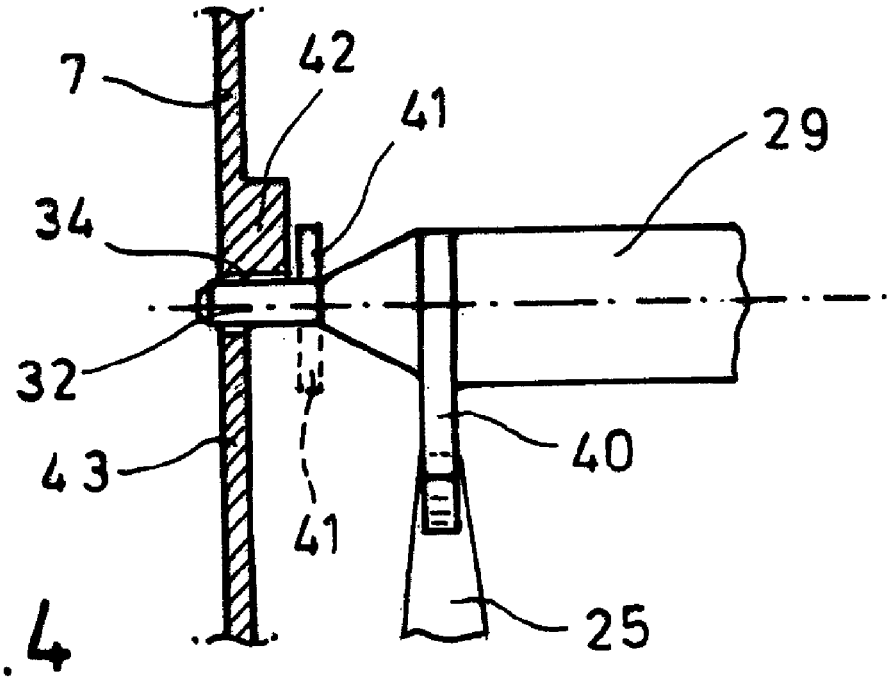
Fig.4

THERMAL AND/OR MAGNETIC OVERLOAD TRIP

CROSS REFERENCE TO PRIOR APPLICATIONS

This application is a U.S. National Phase application under 35 U.S.C. §371 of International Application No. PCT/EP2007/004198, filed May 11, 2007, and claims benefit to German Patent Application Nos. DE 10 2006 027 544.6, filed Jun. 14, 2006, and DE 10 2007 010 944.1, filed Mar. 7, 2007. The International Application was published in German on Dec. 21, 2007 as WO 2007/144050 A1 under PCT Article 21 (2).

FIELD

The present invention relates to a thermal and/or magnetic overload trip device for a multi-pole electrical switching device.

BACKGROUND

An overload trip device is generally described in EP 848 404. The housing member accommodating the functional elements of this overload trip device is made from an electrically insulating material. Each current path provided by a conductor strap has associated therewith a chamber-like housing portion bounded by side walls, and the current paths have associated therewith a shared trip shaft which is rotatable about an axis of rotation. When a presettable thermal and/or magnetic threshold is reached, the trip shaft is rotated out of a rest position against the restoring force of a spring until it trips a switching mechanism located outside the housing member. The thermal and magnetic thresholds are set by two manually rotatable adjusting elements whose axes of rotation are perpendicular to the axis of rotation of the trip shaft.

Among the disadvantages of this overload trip device is that its assembly and, also its disassembly, which may become necessary at a later point, are relatively time-consuming and cost-intensive. This is generally because the housing member accommodating the functional elements of the overload trip device has a multipart design, including a frame-like housing part which holds the conductor straps of the individual current paths, the thermal and magnetic trip units, and the trip shaft, and further including a separate holding part which receives the two adjusting elements and has to be screwed to the frame-like housing part above the trip shaft. This separate holding part also serves to support a second, shaft-like transmission element, which is rotated when operating the adjusting element for setting the magnetic threshold value, and which, by means of springs, acts on the armatures associated with the current paths.

SUMMARY

It is an aspect of the present invention to provide an overload trip device that is compact and provides a pre-testable and safely transportable unit which can be easily assembled and disassembled.

In an embodiment, the present invention provides a thermal and/or magnetic overload trip device for an electrical switching device having multiple poles. The overload trip device includes a housing including an electrically insulating material and having a one-part cup-shaped housing member. The housing member having a top wall, a bottom wall, a rear wall, a first side wall, and a second side wall, and the housing member being configured to receive a plurality of functional elements and being at least partially closable at a front thereof via a detachable cover member. The overload trip device further including a conductor strap associated with each of the multiple poles, each conductor strap being disposed in a respectively associated chamber-like housing portion, and a rotatable trip shaft associated with the conductor straps and configured to rotate about a first axis of rotation between a rest position and an actuating position, when at least one of a presettable thermal threshold and a presettable magnetic threshold is reached, so as to trip an associated switching mechanism. The overload trip device further including at least one rotatable adjusting element disposed in the top wall of the housing member and configured to set the at least one of the presettable thermal threshold and the presettable magnetic threshold, the adjusting element being rotatable about a second axis of rotation perpendicular to the first axis of rotation. Further, the housing member is configured so that the plurality of functional elements is insertable therein through the front of the housing member and is couplable to at least one of the walls of the housing member, and wherein the rotatable trip shaft is rotatably supported by a first bearing point disposed in the first side wall of the housing member and a second bearing point disposed in the second side wall of the housing member.

BRIEF DESCRIPTION OF THE DRAWINGS

Further details and advantages of the present invention will become apparent from the exemplary embodiments described below with reference to the figures, of which:

FIG. 3 is a schematic view illustrating the interaction of a first adjusting element with a trip shaft disposed in the overload trip device and denoted by 15 in FIGS. 1 and 2; and FIG. 4 is a partial section through a side wall of the housing in the region of a bearing point for the end portion of a transmission element acting on an armature, in accordance with an embodiment of the present invention.

DETAILED DESCRIPTION

Figure 1:
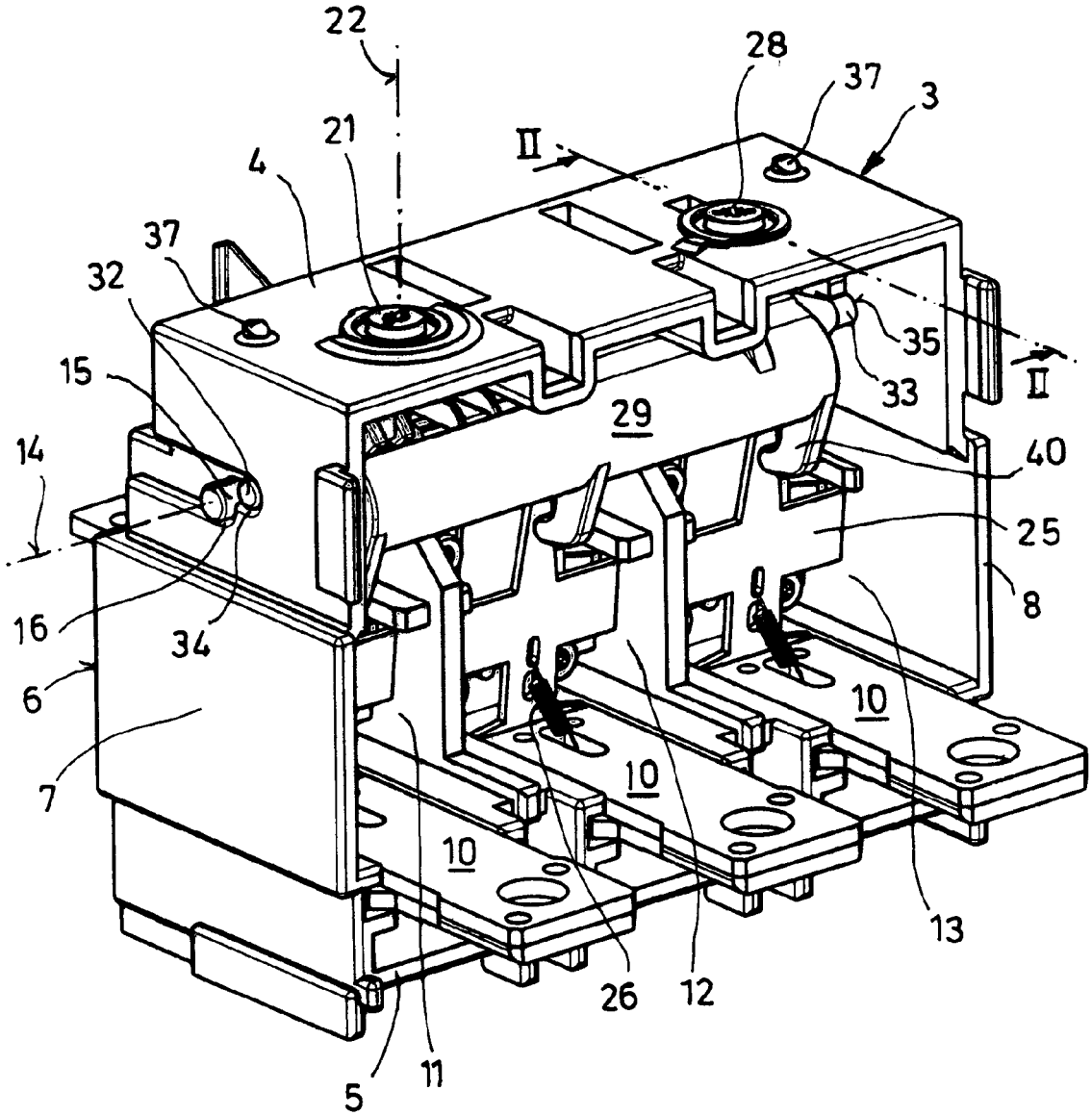
FIG. 1 is a perspective view of an inventive overload trip device for a three-pole switching device, shown with the housing open, in accordance with an embodiment of the present invention.

The present invention is generally based on the idea that the housing of the overload trip device should include a one-part, cup-shaped housing member to accommodate functional components, including the adjusting elements, and that said housing member should be at least partially closable at the front by means of a detachable cover member.

To this end, the cup-shaped housing member is configured on the inside to allow the functional elements to be inserted from the front of this housing member, and to be connected to the inner walls by positive or frictional engagement therewith. Preferably, the cup-shaped housing member is configured such that the trip shaft is inserted into corresponding bearing points in the side walls of the housing member, for example, after the conductor straps are secured to the rear wall of the cup-shaped housing member.

The adjusting elements that set the thermal and/or magnetic thresholds are each rotatably supported in the top wall of the cup-shaped housing member, such that they can be inserted and manually operated from the exterior of the top wall, and that they cooperate with the corresponding functional elements on the inside via connecting elements.

Thermal overload tripping is accomplished by means of strip-shaped bimetal elements which are provided in the cup-shaped housing member and which are responsive to temperature changes, one such bimetal element being associated with each conductor strap and being operatively connected to the rotatable trip shaft via a first transmission element such that when a thermal overload condition occurs, the corresponding bimetal element acts via the first transmission element upon a first arm of the trip shaft to rotate the same from its rest position to its actuating position against the restoring force of a spring.

The particular thermal threshold value is set by means of a first adjusting element which is rotatably supported in the top wall of the cup-shaped housing member and which, via an eccentric peg-like extension, engages a receiving structure of the trip shaft so as to axially displace the same, such that the distance between the respective first transmission element and the opposite surface of the first arm of the trip shaft changes in a predefinable way.

In an alternative embodiment, the particular thermal threshold value may be set by the first adjusting element, via the eccentric peg-like extension, acting into a receiving structure of the strip-shaped first transmission element associated with all of the current paths so as to axially displace said transmission element, such that the distance between the respective bimetal element and the first transmission element changes in a predefinable way.

Magnetic overload tripping is accomplished by means of a pivotable armature which, in response to an overload condition, can be moved toward a second arm of the trip shaft against the restoring force of a spring to rotate the trip shaft from its rest position to its actuating position, it being preferred that each conductor strap have one such armature associated therewith.

The particular magnetic threshold value is set by means of a second adjusting element which is supported in the top wall and which, via a rotatable, second transmission element which is associated with all of the current paths and is disposed parallel to the trip shaft, acts on the armatures associated with the current paths, such that the distance between the respective armature and the second arm of the trip shaft can be changed in a predefinable way.

The second transmission element is advantageously provided with a rib-like actuating element to engage a corresponding contour in the second adjusting element, such that rotation of the second adjusting element causes rotation of the second transmission element. In the process, adjusting arms formed on the transmission element act on the armatures associated with the conductor straps, pushing said armatures toward the second arm of the trip shaft of the overload trip device.

The side walls of the cup-shaped housing member preferably have openings which are designed as bearing points for the end portions of the second transmission element.

Preferably, the trip shaft and/or the second transmission element are parts that can be manufactured inexpensively from an electrically insulating material (such as plastic or hard paper).

Figure 2:
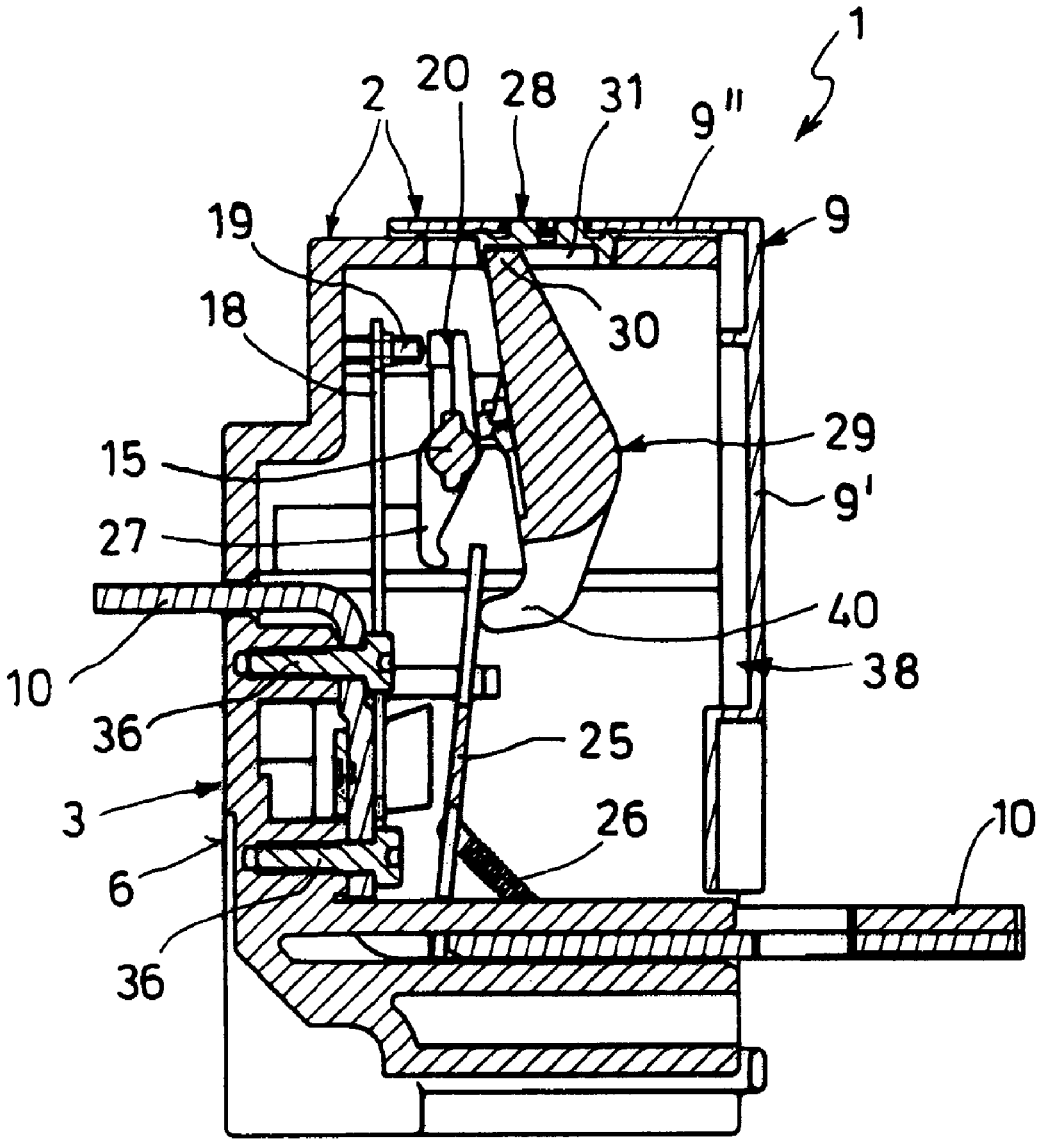
FIG. 2 is a cross-sectional view through the overload trip device shown in FIG. 1, taken along the lines denoted II-II therein, and showing the housing closed, in accordance with an embodiment of the present invention.

In FIG. 2, reference numeral 1 denotes an inventive overload trip device for a three-pole electrical switching device in accordance with an embodiment of the present invention. Overload trip device 1 includes a housing 2 made of plastic. The housing includes a cup-shaped housing member 3 (FIG. 1) including a top wall 4, a bottom wall 5, a rear wall 6, and two side walls 7, 8 and accommodating functional elements of overload trip device 1, and of a detachable cover member 9 (FIG. 2). Cover member 9 includes a first portion 9' for closing the front 38 of cup-shaped housing member 3, and a second portion 9" angularly extending therefrom and used for partially covering top wall 4 of cup-shaped housing member 3.

In accordance with the number of poles of the switching device, three conductor straps 10 pass through housing 2 of overload trip device 1, each conductor strap 10 being disposed in a respectively associated chamber-like housing portion 11-13 bounded by side walls. All conductor straps 10 have associated therewith a shared trip shaft 15, which is disposed in the upper portion of cup-shaped housing member 3 and is rotatable about an axis of rotation 14, and which is preferably injection-molded in one piece from plastic material. Trip shaft 15 is supported in bearing points 16 in side walls 7, 8 of cup-shaped housing member 3. When a presettable thermal and/or magnetic threshold is reached, the trip shaft is rotated from its rest position to an actuating position, in which it trips an associated switching mechanism (not shown).

Thermal overload tripping is accomplished by means of strip-shaped bimetal elements 18 which are provided in cup-shaped housing member 3 and which are responsive to temperature changes, one such bimetal element being secured to each conductor strap 10 and being operatively connected to rotatable trip shaft 15 via a peg-like first transmission element 19 such that when a thermal overload condition occurs, the corresponding bimetal element 18 acts via first transmission element 19 upon a first arm 20 of trip shaft 15 to rotate the same from its rest position to its actuating position.

The particular thermal threshold value is set by means of a first adjusting element 21 which is rotatably supported in top wall 4 of cup-shaped housing member 3 and whose axis of rotation 22 is perpendicular to the axis of rotation 14 of trip shaft 15, said first adjusting element being manually operable externally, for example, using a screwdriver.

First adjusting element 21 has an eccentric peg-like extension 23 (FIG. 3) which engages a forked receiving structure 24 of trip shaft 15 and axially displaces the same in response to rotation of first adjusting element 21, such that the distance between the respective first transmission element 19 and the opposite surface of first arm 20 of trip shaft 15 (which surface has a wedge-shaped contour) changes in a predefinable way. Therefore, the bearing points 16 of trip shaft 15 provided in side walls 7, 8 of cup-shaped housing member 3 is preferably configured to allow such axial movement of trip shaft 15.

In order for the overload trip device 1 to also trip in the event of a magnetic overload, each conductor strap 10 has an at mature 25 pivoted thereto. When a magnetic overload condition occurs, the magnetic field around the particular conductor strap 10 rotates this armature 25 toward second arm 27 of trip shaft 15 against the tension of a spring 26. Actuation of second arm 27 will, in turn, rotate trip shaft 15 from its rest position to its actuating position, such that it releases the switching mechanism (not shown).

The particular magnetic threshold value is set by means of a second adjusting element 28 rotatably supported in top wall 4. Via a rotatable, second transmission element 29 which is associated with all of the conductor straps 10 and is disposed parallel to trip shaft 15, this adjusting element 28 acts on the armatures 25 associated with conductor straps 10, such that rotation of second adjusting element 28 will cause armatures 25 to be pushed toward second arm 27 of trip shaft 15 against the tension of springs 26, and the distance between the respective armature 25 and second arm 27 of the trip shaft of overload trip device 1 changes in a predefinable way.

To this end, second transmission element 29 is provided with a rib-like actuating element 30 to engage a corresponding contour 31 in second adjusting element 28. Moreover, second transmission element 29 is provided with adjusting arms 40 which act on armature 25, pushing it toward second arm 27 of trip shaft 15.

In order to prevent second transmission element 29 from being axially displaced during normal use, the shaft-like end portions 32, 33 of second transmission element 29 each have a radially extending stop cam 41. These stop cams 41 are disposed in front of inwardly projecting portions 42 of side walls 7, 8 of housing 2, thus preventing axial displacement of second transmission element 29.

In order to insert the two end portions 32, 33 into bearing points 34, 35 during the mounting of second transmission element 29, said second transmission element 29 is initially brought into a mounting position, in which each of stop cams 41 is located opposite a portion 43 of side walls 7, 8, said wall portions 43 being set back from wall portions 42 (see FIG. 4, in which the mounting position of stop cam 41 is shown in dashed lines). Because of this, second transmission element 29 may initially be inserted, for example, into bearing point 34, and then be moved relatively far to the left. Then, end portion 33 of the transmission element can be inserted into bearing point 35, after which transmission element 29 can be rotated to its operative position, in which stop cams 41 are located in front of wall portions 42.

Second transmission element 29 is also preferably manufactured as a single injection-molded plastic part, whose end portions 32, 33 are supported in respective bearing points 34, 35 in side walls 7, 8.

Assembly of overload trip device 1 according to the present invention can be accomplished with great ease. Initially, conductor straps 10, together with the bimetal elements 18 and first transmission elements 19 premounted thereto, armatures 25 and springs 26 are inserted from the front 38 of cup-shaped housing member 3 and secured to rear wall 6 by screws 36. After that, trip shaft 15 and second transmission element 29 are inserted into bearing points 16 and 34, 35 of side walls 7, 8, also from the front 38 of cup-shaped housing member 3. Then, the two adjusting elements 21, 28 are inserted into their respective bearing points in top wall 4 and connected to the corresponding connecting elements of trip shaft 15 and/or second transmission element 29, unless they have already meshed with said connecting elements during insertion.

Subsequently, the cover member 9 is slid onto cup-shaped housing member 3 until both parts snap together by means of clips 37. In this manner, cover member 9 firstly closes front opening 38 of cup-shaped housing member 3 and secondly prevents adjusting elements (21, 28) from falling out and inadvertently rotating out of position.

When disassembling overload trip device 1, the above procedure is reversed; that is, initially, cover member 9 is removed. Then, adjusting elements 21, 28 are withdrawn upwardly, and second transmission element 29 and trip shaft 15 are removed at the front. Finally, screws 36 are loosened, and conductor straps 10 are removed through the front, along with the components attached thereto.

Of course, the present invention is not limited to the exemplary embodiment described hereinabove. For example, provision may be made for the particular thermal threshold value to be set by the first adjusting element, via the eccentric peg-like extension, acting into a receiving structure of the strip-shaped first transmission element associated with all of the current paths so as to axially displace said transmission element, such that the distance between the respective bimetal element and the first transmission element changes in a predefinable way. In this case, the trip shaft does not need to be axially displeacable. Reference should further be had to the appended claims.

What is claimed is:

1. A thermal and/or magnetic overload trip device for an electrical switching device having multiple poles, the overload trip device comprising:

a housing including an electrically insulating material and having a one-part cup-shaped housing member, the housing member having a top wall, a bottom wall, a rear wall, a first side wall, and a second side wall, the housing member being configured to receive a plurality of functional elements and being at least partially closable at a front thereof via a detachable cover member configured to slidably engage the housing member via a snap-in arrangement;

a conductor strap associated with each of the multiple poles, each conductor strap being disposed in a respectively associated chamber-like housing portion;

a rotatable trip shaft associated with the conductor straps and configured to rotate about a first axis of rotation between a rest position and an actuating position, when at least one of a presettable thermal threshold and a presettable magnetic threshold is reached, so as to trip an associated switching mechanism; and at least one rotatable adjusting element disposed in the top wall of the housing member and configured to set the at least one of the presettable thermal threshold and the presettable magnetic threshold, the adjusting element being rotatable about a second axis of rotation perpendicular to the first axis of rotation, wherein the housing member is configured so that the plurality of functional elements is insertable therein through the front of the housing member and is couplable to at least one of the walls of the housing member, and wherein the rotatable trip shaft is rotatably supported by a first bearing point disposed in the first side wall of the housing member and a second bearing point disposed in the second side wall of the housing member.

2. The thermal and/or magnetic overload trip device as recited in claim 1, further comprising a respective strip-shaped bimetal element responsive to temperature changes and associated with each conductor strap, the respective strip-shaped bimetal elements being disposed in the housing member and coupled to the rotatable trip shaft via a respective first transmission element, the strip-shaped bimetal elements being configured, upon a thermal overload condition, to cooperate via the respective first transmission element with a first arm of the rotatable trip shaft so as to rotate the rotatable trip shaft from the rest position to the actuating position.

3. The thermal and/or magnetic overload trip device as recited in claim 2, wherein the at least one rotatable adjusting element includes a first adjusting element configured to set the presettable thermal threshold via a peg-like extension configured to cooperate with a receiving structure of the rotatable trip shaft so as to axially displace the rotatable trip shaft so that a distance between the respective first transmission element and an opposite surface of the first arm of the trip shaft is varied in a predefineable way.

4. The thermal and/or magnetic overload trip device as recited in claim 2, wherein the at least one rotatable adjusting element includes a first adjusting element configured to set the presettable thermal threshold via a peg-like extension configured to cooperate with a receiving structure of the first transmission element so as to axially displace the first transmission element so that a distance between the respective strip-shaped bimetal element and first transmission element is varied in a predefineable way.

5. The thermal and/or magnetic overload trip device as recited in claim 1, further comprising a respective pivotable armature associated with each conductor strap and configured, upon an overload condition, to move toward a second arm of the rotatable trip shaft against a restoring force of a spring so as to rotate the rotatable trip shaft from the rest position to the actuating position so as to trip the switching mechanism.

6. The thermal and/or magnetic overload trip device as recited in claim 5, wherein the at least one rotatable adjusting element includes a second adjusting element disposed in the top wall and configured to set the presettable magnetic threshold via a rotatable second transmission element disposed parallel to the rotatable trip shaft and configured to cooperate with the pivotable armatures so that a distance between the pivotable armature and a second arm of the rotatable trip shaft is varied in a predefineable way.

7. The thermal and/or magnetic overload trip device as recited in claim 6, wherein the second transmission element includes a rib-like actuating element and a plurality of adjusting arms, the rib-like actuating element being configured to cooperate with a contour of the second adjusting element so that a rotation of the second adjusting element induces a rotation of the second transmission element, and each of the adjusting arms being configured to act on a respective one of the pivotable armatures so as to displace the respective armature towards the second arm of the rotatable trip shaft.

8. The thermal and/or magnetic overload trip device as recited in claim 6, wherein each of the first and second side walls include a respective opening bearing point opening configured to receive a respective end portion of the second transmission element.

9. The thermal and/or magnetic overload trip device as recited in claim 8, wherein the end portions of the second transmission element each include a respective radially extending stop cam configured to abut an inner surface of the respective side wall of the housing member so as to prevent axial displacement of the second transmission element.

10. The thermal and/or magnetic overload trip device as recited in claim 1, wherein the rotatable trip shaft includes an electrically insulating material.

11. The thermal and/or magnetic overload trip device as recited in claim 10, wherein the electrically insulating material includes at least one of a plastic and a hard paper.

12. The thermal and/or magnetic overload trip device as recited in claim 6, wherein the second transmission element includes an electrically insulating material.

13. The thermal and/or magnetic overload trip device as recited in claim 12, wherein the electrically insulating material includes at least one of a plastic and a hard paper.

14. The thermal and/or magnetic overload trip device as recited in claim 1, wherein the detachable cover member includes a first portion configured to cover the front of the housing member, and a second portion extending angularly from the first portion and configured to secure the at least one adjusting element.

15. The thermal and/or magnetic overload trip device as recited in claim 1, wherein the housing member and the cover member are coupled via at least one clip-type connector.

16. The thermal and/or magnetic overload trip device as recited in claim 1, wherein each of the chamber-like housing portions is bounded by respective side walls.

17. A thermal and/or magnetic overload trip device for an electrical switching device having multiple poles, the overload trip device comprising:

a housing including an electrically insulating material and having a one-part cup-shaped housing member, the housing member having a top wall, a bottom wall, a rear wall, a first side wall, and a second side wall, the housing member being configured to receive a plurality of functional elements and being at least partially closable at a front thereof via a detachable cover member;

a conductor strap associated with each of the multiple poles, each conductor strap being disposed in a respectively associated chamber-like housing portion;

a rotatable trip shaft associated with the conductor straps and configured to rotate about a first axis of rotation between a rest position and an actuating position, when at least one of a presettable thermal threshold and a presettable magnetic threshold is reached, so as to trip an associated switching mechanism;

at least one rotatable adjusting element disposed in the top wall of the housing member and configured to set the at least one of the presettable thermal threshold and the presettable magnetic threshold, the adjusting element being rotatable about a second axis of rotation perpendicular to the first axis of rotation; and a respective pivotable armature associated with each conductor strap and configured, upon an overload condition, to move toward a second arm of the rotatable trip shaft against a restoring force of a spring so as to rotate the rotatable trip shaft from the rest position to the actuating position so as to trip the switching mechanism, wherein the at least one rotatable adjusting element includes a second adjusting element disposed in the top wall and configured to set the presettable magnetic threshold via a rotatable second transmission element disposed parallel to the rotatable trip shaft and configured to cooperate with the pivotable armatures so that a distance between the pivotable armature and a second arm of the rotatable trip shaft is varied in a predefineable way, wherein the housing member is configured so that the plurality of functional elements is insertable therein through the front of the housing member and is couplable to at least one of the walls of the housing member, and wherein the rotatable trip shaft is rotatably supported by a first bearing point disposed in the first side wall of the housing member and a second bearing point disposed in the second side wall of the housing member.

18. The thermal and/or magnetic overload trip device as recited in claim 17, wherein the second transmission element includes a rib-like actuating element and a plurality of adjusting arms, the rib-like actuating element being configured to cooperate with a contour of the second adjusting element so that a rotation of the second adjusting element induces a rotation of the second transmission element, and each of the adjusting arms being configured to act on a respective one of the pivotable armatures so as to displace the respective armature towards the second arm of the rotatable trip shaft.

19. The thermal and/or magnetic overload trip device as recited in claim 17, wherein each of the first and second side walls include a respective bearing point opening configured to receive a respective end portion of the second transmission element.

20. The thermal and/or magnetic overload trip device as recited in claim 19, wherein the end portions of the second transmission element each include a respective radially extending stop cam configured to abut an inner surface of the respective side wall of the housing member so as to prevent axial displacement of the second transmission element.

21. The thermal and/or magnetic overload trip device as recited in claim 17, wherein the second transmission element includes an electrically insulating material.

22. The thermal and/or magnetic overload trip device as recited in claim 21, wherein the electrically insulating material includes at least one of a plastic and a hard paper.

* * * * *